US009107490B2

(12) United States Patent
Lafleur et al.

(10) Patent No.: US 9,107,490 B2
(45) Date of Patent: Aug. 18, 2015

(54) MULTI-AXIS ARTICULATED IMPLEMENT

(76) Inventors: Andre Lafleur, Boucherville (CA); Eric Bussiere, Saint-Julie (CA)

( * ) Notice: Subject to any disclaimer, the term of this patent is extended or adjusted under 35 U.S.C. 154(b) by 1083 days.

(21) Appl. No.: 13/019,730

(22) Filed: Feb. 2, 2011

(65) Prior Publication Data

US 2011/0188923 A1 Aug. 4, 2011

Related U.S. Application Data

(60) Provisional application No. 61/282,398, filed on Feb. 2, 2010.

(30) Foreign Application Priority Data

Feb. 2, 2010 (CA) ..... 2701090

(51) Int. Cl.

| | |
|---|---|
| ***A46B 5/00*** | (2006.01) |
| ***A46B 15/00*** | (2006.01) |
| ***A47L 13/022*** | (2006.01) |
| ***A47L 13/08*** | (2006.01) |
| ***A47L 13/12*** | (2006.01) |
| ***B25G 1/06*** | (2006.01) |

(52) U.S. Cl.

CPC ..... *A46B 5/0075* (2013.01); *A46B 5/0087* (2013.01); *A46B 15/0055* (2013.01); *A46B 15/0081* (2013.01); *A47L 13/022* (2013.01); *A47L 13/08* (2013.01); *A47L 13/12* (2013.01); *B25G 1/06* (2013.01); *A46B 2200/3046* (2013.01); *Y10T 403/32008* (2015.01); *Y10T 403/32442* (2015.01)

(58) Field of Classification Search

CPC ..... Y10T 403/32008; Y10T 403/32442; A46B 5/0087; A47L 13/022

USPC ..... 403/76, 78, 83, 84, 90, 91, 103, 104, 403/129, 143; 15/105, 111, 117, 143.1, 15/144.1, 144.2, 144.3, 144.4, 145, 172, 15/236.02; 16/429, 436, 900, DIG. 41

See application file for complete search history.

(56) References Cited

U.S. PATENT DOCUMENTS

| | | | | |
|---|---|---|---|---|
| 2,280,165 | A | 4/1942 | Sebastian | |
| 2,680,032 | A * | 6/1954 | McClenahan | 403/97 |
| 2,764,774 | A * | 10/1956 | Belsky et al. | 15/228 |
| 4,763,377 | A | 8/1988 | Madsen | |
| 5,551,115 | A | 9/1996 | Newille | |
| 6,128,800 | A | 10/2000 | Vosbikian | |
| 6,152,635 | A * | 11/2000 | Wu | 401/270 |

(Continued)

*Primary Examiner* — Michael P Ferguson
*Assistant Examiner* — Nahid Amiri
(74) *Attorney, Agent, or Firm* — Benoît & Côté Inc.

(57) ABSTRACT

A lockable articulated joint comprises a first member having a ball shaped attachment further having a recess on its periphery. A rotationally symmetric conforming plunger is for movably nesting into the recess. A second member pivotally receives the ball shaped attachment and comprises a plunger holding portion. User alignment of the recess with the plunger holding portion allows configuring the joint in one of at least two selectable locked positions. The articulated joint is usable in a multi-axis articulated implement, in which one member is an elongated end effecter having a working face and the other member is an elongated handle portion. A user may configure the implement in various locked attitudes, wherein a working face's longitudinal axis extends parallel or perpendicular to the handle, or wherein the working face's normal axis extends parallel to the handle. The implement may be embodied into a multi-axis snow brush.

18 Claims, 8 Drawing Sheets

(56) References Cited

U.S. PATENT DOCUMENTS

| | | | | |
|---|---|---|---|---|
| 6,481,041 | B1 * | 11/2002 | Ingram | 15/111 |
| 6,625,837 | B2 | 9/2003 | Jiang | |
| 6,990,705 | B1 | 1/2006 | Schouten et al. | |
| 7,055,204 | B2 * | 6/2006 | Ajluni | 15/121 |
| 7,155,770 | B2 * | 1/2007 | Anderson et al. | 15/111 |
| 7,670,077 | B2 * | 3/2010 | Jan et al. | 403/90 |
| 7,761,949 | B1 * | 7/2010 | Hughes, IV | 15/172 |
| 2004/0182952 | A1 * | 9/2004 | Soller et al. | 239/228 |
| 2004/0250365 | A1 | 12/2004 | Anderson et al. | |
| 2007/0234497 | A1 * | 10/2007 | Lee | 15/144.1 |
| 2010/0186181 | A1 * | 7/2010 | Tawara | 15/144.4 |

* cited by examiner 1
30a
10
12
13
N
30b
11

26
22
28
27
23
235
231
21
20
10
21b
21a
30b
30a
L 26
22
28
20
27
1
23
235
231
212
21
13
12
21a
N
30a
32
10
11

26
22
28
27
23
235
1
231
212
21a
12
13
21
32
30a
21b
213
47
10
L

88a

88b

88c

88d

88e

89a

89b

89c

90a

90b

90c

89d

90e

91a

91b

92a

92b

93a

93b

93c

MULTI-AXIS ARTICULATED IMPLEMENT

TECHNICAL FIELD

The present disclosure generally relates to articulated implements and, more specifically, to a lockable articulated joint having a rotationally symmetric plunger for locking the joint in at least two positions.

BACKGROUND

Cleaning implements such as brushes or cleaning pads are often provided with multi-axis pivotal joints connecting an end effecter to a handle to enable selective or continuous adaptation of the angular orientation of the end effecter with respect to the handle according to the job being carried out. For example, certain types of snow removal brushes for vehicles are provided with an adjustable joint allowing a user to select between two configurations of the brush, e.g. a "T" configuration wherein the elongated end effecter lies perpendicularly to the handle axis, or a linear configuration wherein the end effecter is co-extending along the handle axis. According to some concepts, a plurality of discrete lockable positions is provided about a given axis of rotation.

For example, U.S. Pat. No. 6,625,837 (Jiang—September 2003) discloses a cleaning brush comprising an angle adjuster which enables lockable rotation of the elongated end effecter about a single axis perpendicular to the handle but generally parallel to the bristles' orientation. Some other examples of single axis pivotal joint cleaning implements have been taught, such as U.S. Pat. No. 2,280,165 (Sebastian—April 1942), U.S. Pat. No. 6,128,800 (Vosbikian—October 2000), U.S. Pat. No. 6,990,705 (Schouten—January 2006), and US patent application No. 2004/0250365 by Anderson et al.

However, in conventional snow removal implements, end effecter's bristles (i.e. the efficient face normal axis) extend substantially perpendicular to the handle axis, regardless of the selected configuration. Obviously, this limitation prevents the user from performing certain tasks which require the bristles to extend along the handle axis as a prolongation thereof, substantially in a common plane, such as in a broom. Although some existing cleaning implements comprise a multi-axis swiveling joint connection of the universal joint type to continuously adapt to performed job changing effecter orientation requirements, such solutions do not provide the level of effecter control needed in performing many tasks which require transmission of working forces from the handle to the effecter through a rigid coupling joint. This is namely exemplified from U.S. Pat. No. 5,551,115 (Newville—September 1996) showing a ball and socket brush head connection freely pivoting about two orthogonal axes, and in U.S. Pat. No. 4,763,377 (Madsen—August 1988) teaching a swiveling scrub brush structure featuring adjustable friction swivel movement about two orthogonal axes, without enabling quick changeover between user selectable predetermined lockable configurations.

SUMMARY

A lockable articulated joint capable of locking into multiple positions would be usable in a wide variety of applications. One such application would bring a significant advance in the art of cleaning implements, such as snow brushes, as well as in other types of implements in which an end effecter is connected to a handle, to provide a multi-axis user selectable articulation joint for improved flexibility and performance. The present disclosure provides a user selectable articulated joint implement obviating the limitations and drawbacks of earlier devices.

In a first aspect of the present disclosure, a lockable articulated joint comprises a first member, a conforming plunger, and a second member. The first member has a ball shaped attachment, with a recess provided about a periphery of the ball. The plunger is adapted for movable nesting into the recess, the plunger having a non-circular, rotationally symmetric shape. The second member is adapted to pivotally receive the ball shaped attachment and comprises a plunger holding portion. User selectable alignment of the recess with the plunger holding portion allows configuring the lockable articulated joint in one of at least two selectable locked positions.

In a second aspect of the present disclosure, a multi-axis articulated implement comprises an elongated end effecter, at least one conforming plunger, and an elongated handle portion. The elongated end effecter has a working face defining a longitudinal axis and a normal axis, and a ball shaped attachment having a plurality of recesses provided about its periphery. The at least one conforming plunger is adapted for movable nesting into at least one of said recesses. The elongated handle portion defines a proximal end and a distal end portion adapted to pivotally receive the ball attachment. The elongated handle portion also comprises at least one plunger holding portion. User selectable alignment of at least one of the plurality of recesses with the at least one plunger holding portion configures the implement in one of three locked attitudes. These comprise a first locked attitude, in which the working face's longitudinal axis is extending substantially parallel to the handle, a second locked attitude, in which the working face's longitudinal axis extends substantially perpendicular to the handle, and a third locked attitude, in which the working face's normal axis extends substantially parallel to the handle.

In a third aspect of the present disclosure, a lockable articulated joint comprises a first member and a second member. The first member has a ball shaped attachment, a ridge being provided about a periphery of the ball. The ridge has a non-circular, rotationally symmetric shape. The second member is adapted to pivotally receive the ball shaped attachment and comprises a conforming recess adapted for nesting of the ridge. User selectable alignment of the conforming recess with the ridge allows configuring the lockable articulated joint in one of at least two selectable locked positions.

The foregoing and other features will become more apparent upon reading of the following non-restrictive description of illustrative embodiments thereof, given by way of example only with reference to the accompanying drawings.

BRIEF DESCRIPTION OF THE DRAWINGS

In the appended drawings.

Similar parts are represented by identical numerals throughout the drawings and description.

DETAILED DESCRIPTION

Figures 1A, 1B, 1C, 1D:
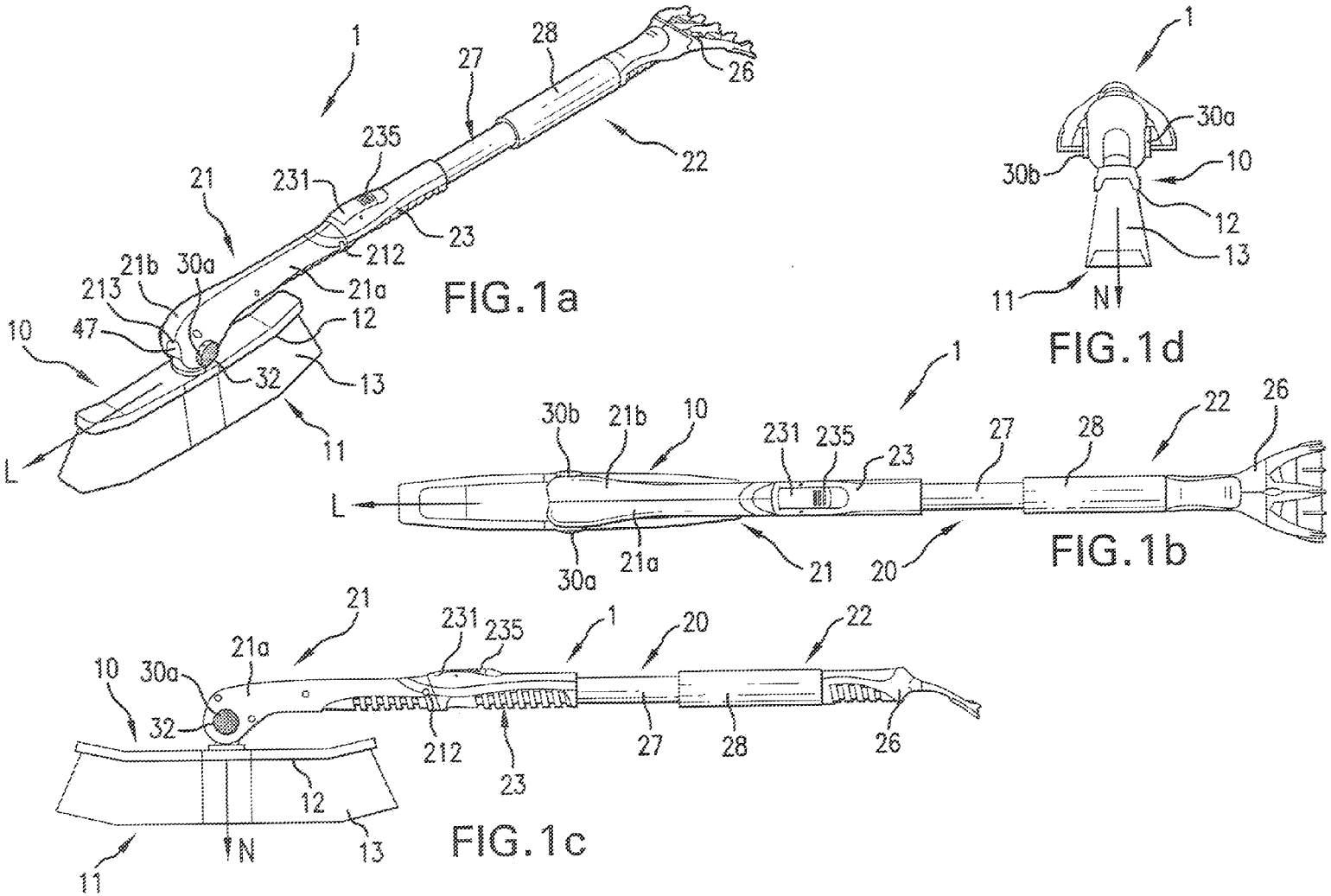
FIG. 1*a* is a perspective view of an example of multi-axis articulated implement representing an extensible snow brush.
FIG. 1*b* is a top plan view of the multi-axis articulated implement of FIG. 1*a;*
FIG. 1*c* is a side elevation view of multi-axis articulated implement of FIG. 1*a;*
FIG. 1*d* is a front elevation view of the multi-axis articulated implement of FIG. 1*a;*

A lockable articulated joint of the present disclosure, capable of being locked in at least two positions, may be embodied into a wide range of implements comprising end effecters of different types adapted to different tasks.

More specifically, an embodiment comprises a multi-axis articulated implement comprising i) an elongated end effecter having a working face defining a longitudinal axis and a normal axis, and a ball shaped attachment having a plurality of recesses provided about its periphery, ii) at least one conforming plunger adapted for movable nesting into at least one of said recesses, and iii) an elongated handle portion defining a proximal end and a distal end portion adapted to pivotally receive said ball attachment and comprising at least one plunger holding portion. Thereby, a user may selectively configure the implement in at least a first locked attitude wherein the working face's longitudinal axis is extending substantially parallel to the handle, a second locked attitude wherein the working face's longitudinal axis extends substantially perpendicular to the handle, or a third locked attitude wherein the working face's normal axis extends substantially parallel to the handle, by operating proper alignment of at least one of the recesses with the at least one plunger holding portion.

Another embodiment comprises a multi-axis articulated implement comprising i) an elongated end effecter having a working face defining a longitudinal axis and a normal axis, and a ball shaped attachment having at least first and second plunger receiving recesses provided along a common latitudinal line of the ball, ii) at least first and second plungers respectively conforming to said first and second recesses and movably nested therein, and iii) an elongated handle portion defining a proximal end and a distal end portion adapted to pivotally receive said ball attachment and defining at least one opening having a plunger receiving portion, whereby a user may selectively configure the implement in a first locked attitude wherein the working face's longitudinal axis is extending substantially parallel to the handle by registering the first plunger with the opening, a second locked position wherein the working face's longitudinal axis extends substantially perpendicular to the handle by registering the second plunger with the opening with a first relative orientation, or in a third locked attitude wherein the working face's normal axis extends substantially parallel to the handle by registering the second plunger with the opening with a second relative orientation.

In an embodiment, the multi-axis articulated implement may further comprise at least one plunger biasing device such as a compression spring to bias each plunger in an extended attitude. Springs may be mounted in each recess behind a plunger to urge said plunger away from the recess.

According to another embodiment, the multi-axis articulated implement may further comprise a release press button movably mounted into an outer portion of said opening for applying a force on a plunger engaged in the plunger receiving portion of the opening to compress the biasing device and retract said plunger further into the recess and thereby unlock the end effecter and enable movement thereof.

In a further embodiment, the plungers and the plunger receiving portion of the opening may adopt a geometric shape defining four 90° apart lockable relative positions. The shape may define a cross, a square shape, a four branch star, and the like.

In another embodiment, the plungers may be provided with rounded (beveled) edges to ease engagement with the receiving portion of the opening, but sharp enough to maintain lock position.

In a still further embodiment, the ball shaped attachment may further comprise third and fourth plunger receiving recesses and third and fourth matching nested plungers equally distributed along with the first and second recesses on the common latitudinal line. In an embodiment, the latitudinal line may be the equatorial line.

In an embodiment particularly addressing the need for snow removal, the working face may be provided with bristles projecting generally in the direction of a normal axis thereof to define a brush.

Cleaning of vertical surfaces of a vehicle may be carried out with an implement configurable such that bristles extend along a handle axis, as a prolongation thereof, substantially in a common plane with the handle axis, as in the case of a straight broom. The present disclosure provides a combination of selectable implement configurations enabled through rotation of the end effecter about either one of two orthogonal axes defining a plane perpendicular to the handle axis.

Although a snow removal brush will be described in the following, as an illustrative embodiment of the disclosure, it should be understood that the disclosed articulated joint may be used in various other applications. Non-limiting examples of uses of the lockable articulated joint include various types of tool holders, frame holders, display holders, ergonomic apparatuses, and the like. The exemplary embodiments of a snow removal brush are therefore not meant to limit the present disclosure.

FIGS. 1*a* to 1*c* are, respectively, a perspective view, a top plan view and a side elevation view of an example of multi-axis articulated implement representing an extensible snow brush. A snow brush, which in the present example is extensible, comprises a multi-axis articulated hand implement 1 provided with a multi-axis joint connecting an elongated end effecter 10, for example a brush, to a distal end portion 21 of an elongated extensible handle 20, also defining a proximal end 22 and a length adjusting device 23 to adjust the distance between the distal end and the proximal end.

Figure 2A:
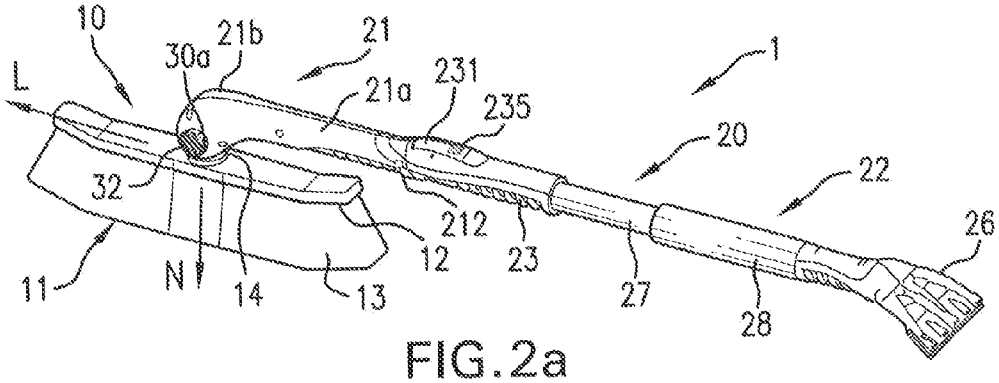
FIG. 2*a* is a perspective view of the multi-axis articulated implement of FIG. 1*a*, shown in a first configuration.
Figure 2B:
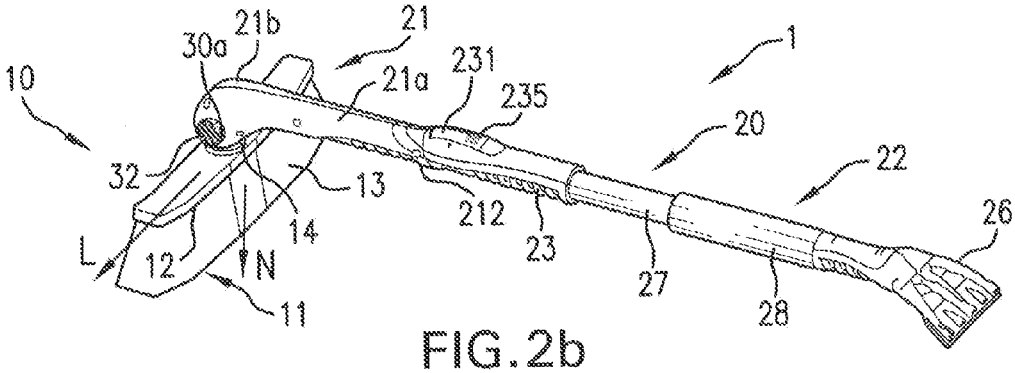
FIG. 2*b* is perspective view of multi-axis articulated implement of FIG. 1*a*, shown in a second configuration.
Figure 2C:
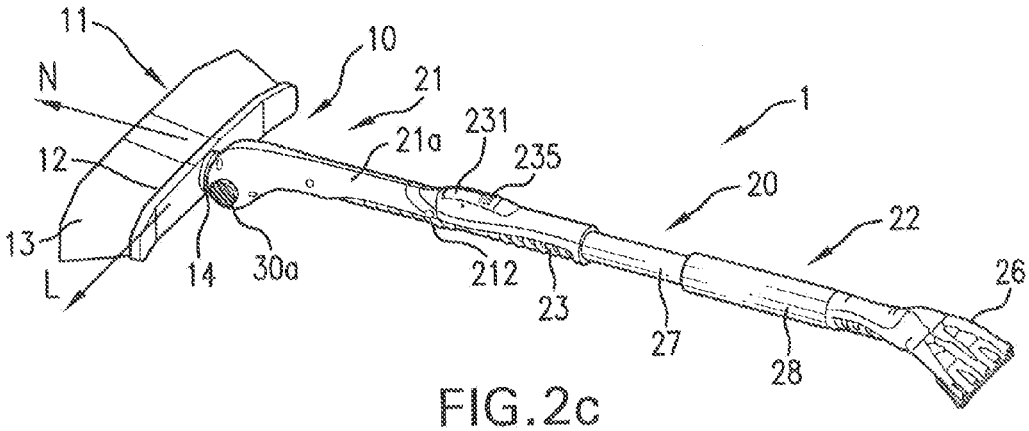
FIG. 2*c* is a perspective view of multi-axis articulated implement of FIG. 1*a*, shown in a third configuration.

The end effecter 10 defines a working face 11 defining a longitudinal axis L and a normal axis N, and a base surface 12 populated with brush bristles 13 projecting therefrom generally in the direction of the normal axis N. The orientation of the end effecter 10 with respect to the handle 20 may be changed to enable a plurality of brush configurations as illustrated in FIGS. 2*a* to 2*c*, which are perspective views of the multi-axis articulated implement of FIG. 1*a* shown, respectively, in a first, second and third configuration. Release push buttons 30*a* and 30*b* are used to unlock the multi-axis joint and perform the reorientation of the end effecter 10.

As shown in FIGS. 2*a* to 2*c*, the end effecter 10 of the hand implement 1 may be configured in either of three attitudes with respect to the handle 20. Firstly, as illustrated in FIG. 2*a*, the end effecter 10 may be set with its longitudinal axis L extending generally parallel to the longitudinal axis of handle 20 and the normal axis N and bristles 13 projecting generally orthogonal to the handle axis. Secondly, the implement end effecter 10 may be set so that its longitudinal axis L extends generally perpendicular to the handle axis as illustrated in FIG. 2*b*, the normal axis N and bristles 13 still projecting generally orthogonal to the handle axis. Thirdly, the end effecter 10 may be so oriented that the normal axis N and the bristles 13 project generally parallel to the handle's longitudinal axis, and the axis L lies orthogonal and substantially in the same plane as the handle axis, to adopt a substantially coplanar broom like configuration as illustrated in FIG. 2*c*.

Figure 3A:
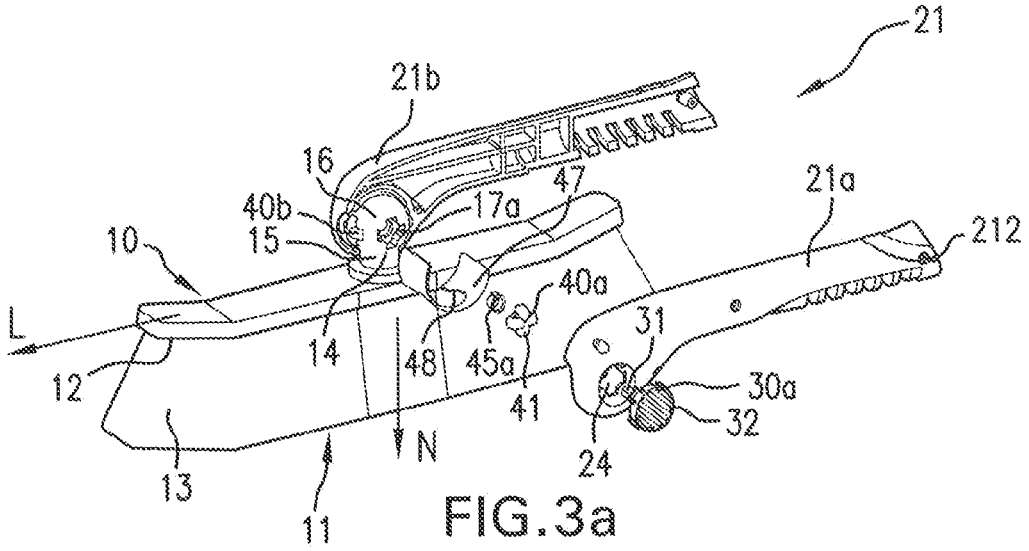
FIG. 3*a* is a perspective exploded view of a distal portion of the implement of FIG. 1*a*, showing internal details of a multi-axis lockable articulated joint in a first position.
Figure 3B:
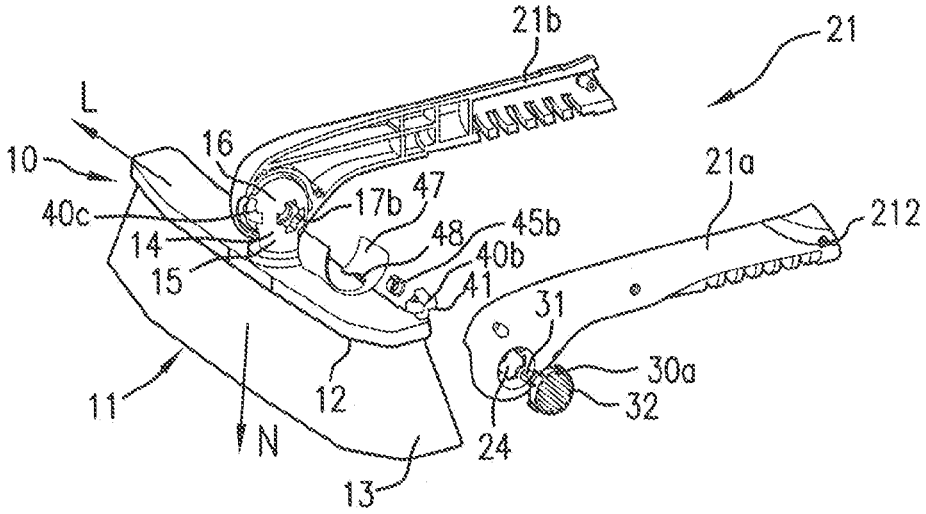
FIG. 3*b* is a perspective exploded view of the distal portion of the implement of FIG. 1*a*, showing internal details of the multi-axis lockable articulated joint in a second position.
Figure 3C:
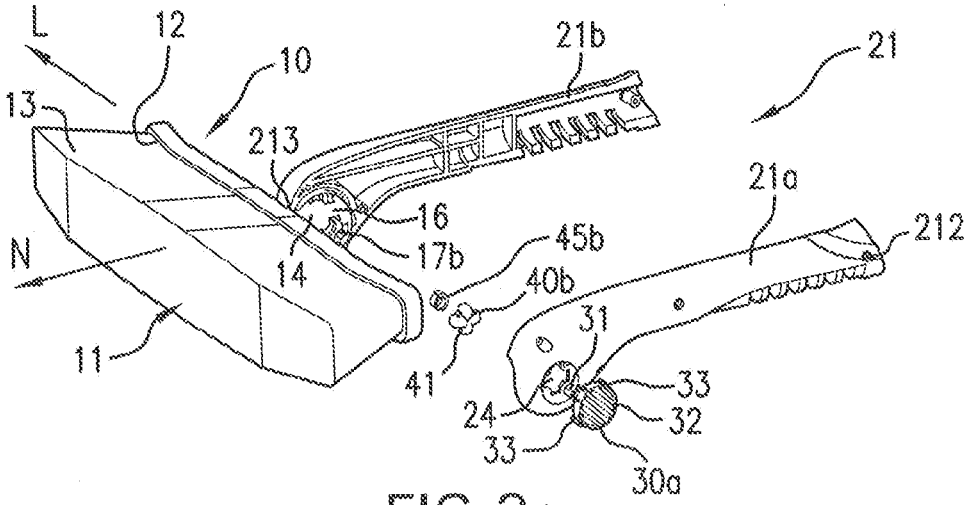
FIG. 3*c* is a perspective exploded view of the distal portion of the implement of FIG. 1*a*, showing internal details of the multi-axis lockable articulated joint in a third position.

Turning now to FIGS. 3*a* to 3*c*, which are perspective exploded views of a distal portion of the implement of FIG. 1*a*, showing internal details of a multi-axis lockable articulated joint in, respectively, a first, second and third position, a first embodiment of the multi-axis lockable articulated joint will be described in details. A ball shaped attachment 14 defining a neck portion 15 and a ball portion 16 projects from a top surface of the end effecter 10. The ball 16 is provided with a first recess 17*a* for receiving a first conforming plunger 40*a* and a second recess 17*b* for receiving a second conforming plunger 40*b*.

Figure 4:
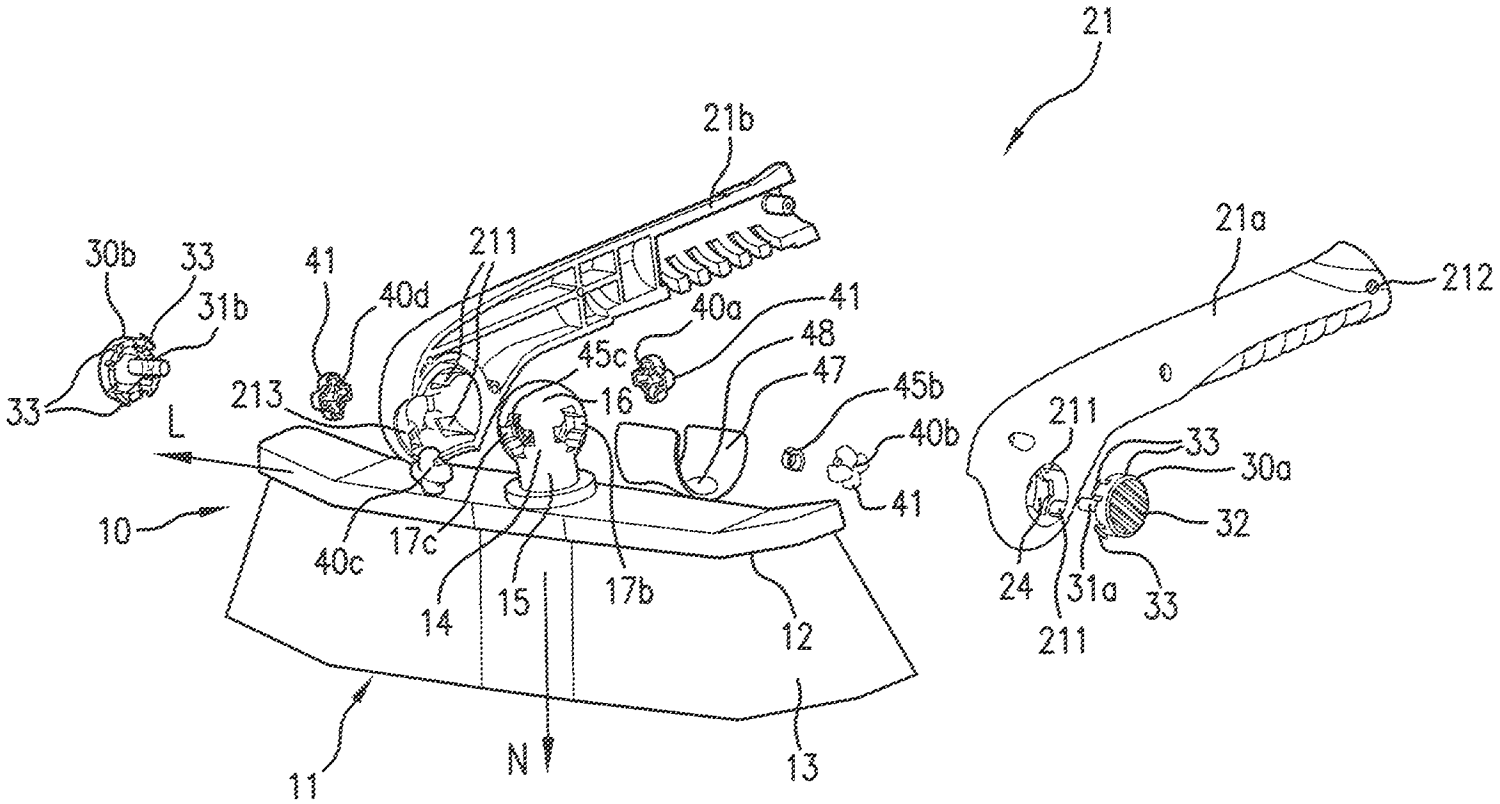
FIG. 4 is a perspective exploded view of the distal portion of the implement, in the second configuration of FIG. 2*b*, showing internal details of the multi-axis lockable articulated joint according to an embodiment.

Although only two recess/plunger sets are visible on FIGS. 3*a-c*, four orthogonal sets may be provided as best viewed from FIG. 4, which is a perspective exploded view of the distal portion of the implement, in the second configuration of FIG. 2*b*, showing internal details of the multi-axis lockable articulated joint according to an embodiment. The four orthogonal recess/plunger sets enable continuous rotation of the end effecter in one direction in a plane, with locking positions every 90°, and superior locking and general mechanical strength. However, it is contemplated that a functional implement 1 according to the disclosure may be comprised of only two recess/plunger sets 90° apart on the equatorial line of the ball 16. In such a case, only one push button 30 is required to set the end effecter 10 parallel (FIG. 2*a*) or perpendicular (FIG. 2*b*) to the handle axis, but only two angular stops of the end effecter would be enabled.

The description will now proceed with reference to a four plunger embodiment of the disclosure. As seen from FIG. 4, ball 16 accordingly comprises four recesses 17 (17*b* and 17*c* shown) positioned 90° apart along the same equatorial line, to provide four 90° apart stop positions around the circumference of ball 16. Therefore, four plungers 40*a* to 40*d* are movably nested in their respective recess, being outwardly biased by a compression spring such as 45*a*. Two openings 24*a* and 24*b* as well as two push buttons 30*a* and 30*b* are provided on respective halves 21*a* and 21*b* of the distal end portion 21. Each opening 24 forms a plunger holding portion. The openings 24*a* and 24*b* each comprise an inner portion so sized and shaped to receive and hold the portion of a plunger 40*a*-40*d* protruding from the surface of the ball 16 of attachment 14 to lock the end effecter 10 in one of the predetermined positions.

Figures 5A, 5B, 5C, 5D, 5E, 5F, 5G, 5H, 5I, 5J, 5K, 5L, 5M, 5N, 5O, 5P, 5Q, 5R, 5S, 5T:
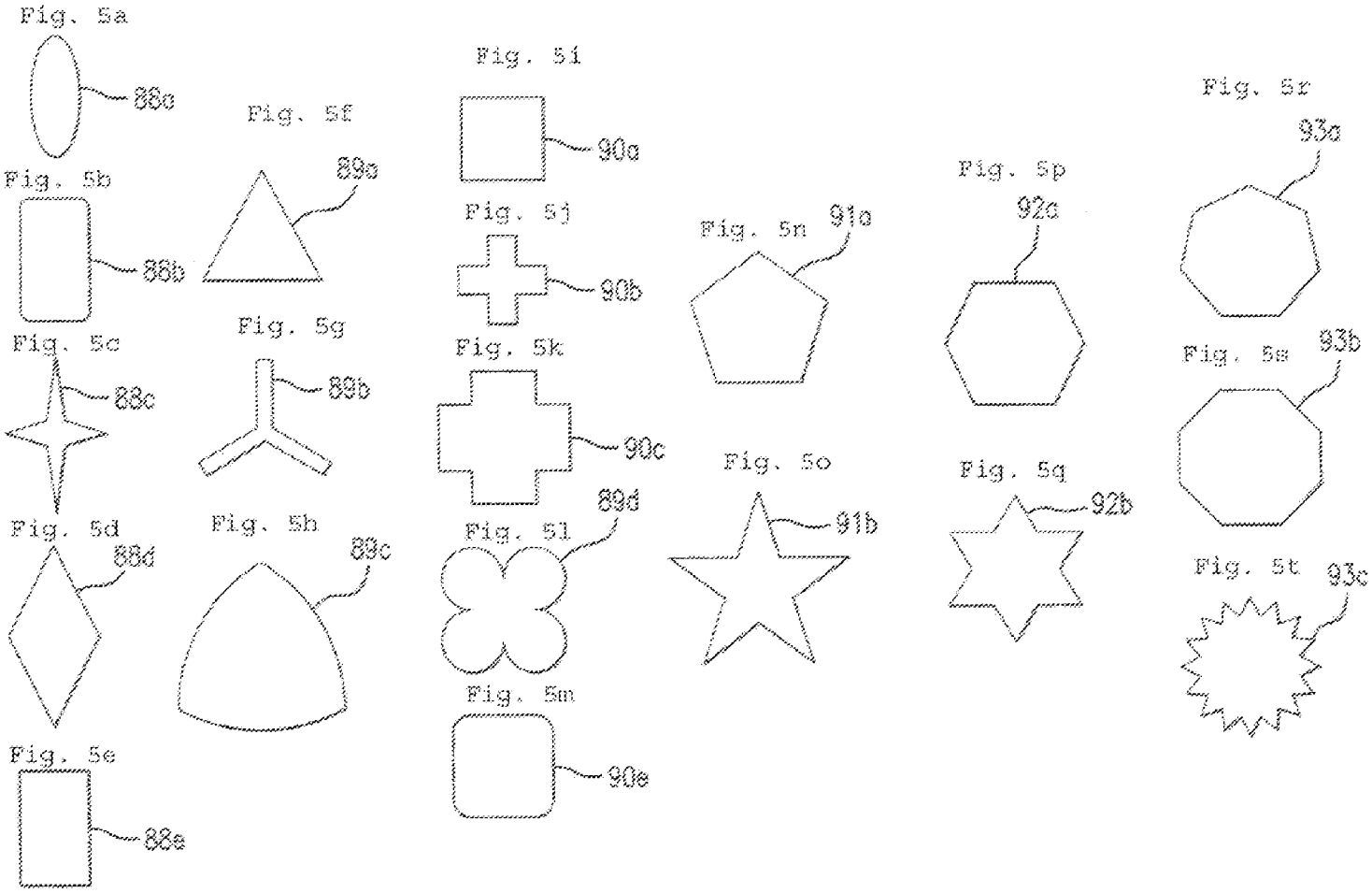
FIGS. 5*a*-5*t* show a variety of plunger shapes that may be used in a lockable articulated joint.

In the embodiment shown, the plungers 40*a*-40*d* are given a cross shape in order to enable insertion in four 90° apart angular positions into each opening 24*a*, 24*b*. Alternatively, a square plunger section may be contemplated for similar results and other shapes such as an eight branch star could be contemplated to enable indexing to 45° apart locking positions or other desired end effecter pivoting options. FIGS. 5*a*-5*t* show a variety of plunger shapes that may be used in a lockable articulated joint. A geometric shape of the plunger is non-circular and is rotationally symmetric, in the sense that the shape is substantially identical to itself when rotated by 180 degrees or less, allowing for minor variations due for example to manufacturing tolerances. For example, a plunger having any of the shapes 88*a* to 88*e* may allow the articulated joint to lock in two (2) opposite positions, following a 180-degree rotation. A plunger having any of shapes 89*a* to 89*c* may allow the articulated joint to lock in three (3) positions separated by 120 degree angle. Shapes 90*a* to 90*e* allow four (4) distinct positions at right angles. Shapes 91*a* and 91*b* allow five (5) distinct positions, shapes 92*a* and 92*b* allow six (6) distinct positions and shapes 93*a* to 93*c* allow of the articulated joint at higher numbers of positions. In fact, any one of an oval, a rectangle. A lozenge, an equilateral triangle, a reuleaux triangle, a square, a cross having identical arms, a regular polygon or a star having at least three identical branches may form a suitable plunger shape, this list being non-limiting. It is therefore possible to use plungers and matching recesses offering a large number of positions, using for example shape 93*c*. Of course, the various shapes shown on FIG. 5*a*-5*t* are non-limiting and those of ordinary skill in the art will be able to select various other suitable shapes. In FIGS. 3*a*-3*c* and 4, the recesses 17, the plungers 40 and the openings 24 all share a similar cross shape. A variation may comprise, for example, rectangular recesses and rectangular plungers, having the shape as shown at item 88*e* of FIG. 5*e*, along with a plunger holding portion having a cross-shaped opening, as shown at item 90*c* of FIG. 5*i*. Such a combination also allows locking of the articulated joint in four 90° apart angular positions. In this particular case, a plunger shaped as 88*e*, being symmetrical along one axis, may connect with an opening that is symmetrical along two axes, being shaped as 90*c*. Other combinations may also be contemplated, in which a plunger is capable of matching a recess for locking the articulated joint in at least two angular positions. A lockable articulated joint using any of the various rotationally symmetric shapes described herein may comprise a release mechanism such as the release push buttons 30*a* and/or 30*b*, shown on the preceding Figures, or any other release mechanism described herein.

The end effecter 10 and the distal end portion 21, as shown for example on FIG. 4, may, for various applications, be substituted by other elements. A lockable articulated joint may be advantageously used in a wide variety of contexts. A ball, similar to the ball 16, may therefore be attached to, connected to, or made integral with a first member. A second member may be adapted to pivotally receive the ball. One of the first or second members may be attached to a fixed location, such as a wall, a floor, a machine, a piece of furniture, and the like. Another of these members, or both members, may be attached to movable devices, such as a tool. Both members may be part of a same device, such as for example a table lamp having a configurable shape and orientation. Regardless of its use, the lockable articulated joint comprises, in addition to the first and second members, one or more rotationally symmetric conforming plungers adapted for movable nesting into the recess. As expressed hereinabove, the one or more plungers have a non-circular shape that is substantially identical to their shape rotated by 180 degrees or less. The second member comprises at least one plunger holding portion. A user of the articulated joint may change configuration of the joint by moving the first member in relation to the second member until at least one of the plungers is aligned with at least one of the plunger holding portions. At least because of the shape of the plunger(s), the articulated joint may be locked in at least two possible positions. If the articulated joint comprises more than one plunger, one or more of the plungers may align with any one of the one or more plunger holding portions.

On the preceding Figures, the plungers 40*a*-40*d* are all present on a same equatorial line, sharing a same plane with a center (not shown) of the ball 16. In other embodiments, a number of plungers may be positioned at various places on a ball. For example, a first plunger and a second plunger may form a plane with the center of the ball while a third plunger may be outside of that plane. The first and the second plunger may form a right angle with the center of the ball, or may form other angles, depending on an intended use of the lockable joint. Likewise, a third plunger may be at a normal position from the plane formed by the first and second plungers and the center of the ball. The third plunger, if present, may alternatively be located elsewhere on the periphery of the ball.

In yet other embodiments, a number of plunger holding portions may be positioned at various places on a part of the second member that pivotally receives the ball. For example, a first plunger holding portion and a second plunger holding portion may form a plane with the center of the ball, when the ball is received in the second member, while a third plunger holding portion may be outside of that plane. The first and the second plunger holding portions may form a right angle with the center of the ball, or may form other angles, depending on an intended use of the lockable joint. Likewise, a third plunger holding portion may be at a normal position from the plane formed by the first and second plunger holding portions and the center of the ball. The third plunger holding portion, if present, may alternatively be located elsewhere along the periphery of the ball.

Some applications may require an articulated joint that locks in various positions while also allowing positioning in non-locked positions. Those of ordinary skill in the art will readily be able to make proper selection of numbers, shapes and locations of plungers and plunger holding portions to meet such needs.

From the above, those of ordinary skill in the art will readily appreciate that a lockable articulated joint built according to the present disclosure may lock in a wide variety of positions, and may further be placed in a non-locked position. The first and second members of the lockable articulated joint may be attached to a broad variety of devices, one or both of the members being possibly attached to a device having a permanent fixed position, such as a wall, a floor, furniture, or the like. Therefore the embodiments of the multi-axis articulated hand implement 1 of the preceding Figures, showing cross-shaped plungers 40*a*-40*d* and recesses mounted on a single, equatorial line of the ball 16, for use as a snow cleaning implement, should be understood as exemplary are not meant to limit the present disclosure.

Returning to FIG. 4, two plungers inserted in openings 24*a* and 24*b* are blocking rotation of the end effecter 10 in each of the three (3) selectable positions thereof for high mechanical resistance and stability. Accordingly, unlocking of the multi-axis joint and repositioning of the end effecter may be accomplished by pressing release push buttons 30*a* and 30*b* simultaneously, using for example the thumb and the index of one hand.

The release push buttons 30*a* and 30*b* are snap fitted into openings 211 and held by their peripheral wings 33 while remaining axially movable into the opening 24. Each push button 30*a*, 30*b* comprises a stem portion 31*a*, 31*b* having a tip abutting on the protruding surface of a plunger such as 40*a*, so that an axial pressure applied at the button outer face 32 causes the spring 45*a* to become further compressed, allowing the plunger 40*a* to be urged inwardly into recess 17*a*, thereby at least partially clearing the opening 24. Since the plungers 40*a*-40*d* are provided with beveled rounded edges 41 at their perimeter, smooth transition is enabled between angular positions or insertion/extraction motions of the plungers in/from the opening 24. Therefore, even with partial extraction of a plunger 40 from an opening 24, a slight torque applied on the end effecter 10 in the direction of the desired movement creates a force transferred from the opening edges to the plunger edges, in turn creating an axial force component on the plunger and on the spring 45 to fully extract the plunger from the opening 24 thus enabling moving to another configuration. However, the edges 41 are made sharp enough to provide proper locking when a plunger 40 is fully inserted in an opening 24.

In some embodiments, this characteristic may be exploited to enable position indexing without the help of any release push button 30, provided the plunger edges 41 and spring properties are designed to enable unlocking and position indexing by merely applying a reasonable torque on the end effecter 10. Careful design may balance a limit of a strain that may be applied to the end effecter in use, without causing undesired position unlocking.

In order to allow the end effecter to be movable from the position illustrated in FIG. 3*b* to that illustrated in FIG. 3*c*, an elongated slot 213 having a width slightly wider than the diameter of the neck 15 of attachment 14 is provided through the surface of the distal end portion 21 of the handle 20. A flexible sealing member 47 provided with a key hole 48 for insertion about attachment neck 15 is thus mounted to slide in the articulated joint recess and continuously seal the portion of the slot 213 surrounding the attachment 14 to preserve inner joint components from outside contaminants such as snow and ice.

In use, a user may change the implement 1 from a configuration to another by first grasping handle distal portion 21 and simultaneously pressing the surface 32 of the release push buttons 30*a* and 30*b* with one hand and maintaining the buttons in a depressed position to push the plungers 40 inwardly and thereby extract them from the openings 24*a* and 24*b*, then moving the end effecter 10 out of its current position with his second hand, and then releasing both push buttons 30*a*, 30*b* to allow the registered plungers 40 to extend and engage into the openings 24*a*, 24*b* respectively and thereby lock the end effecter into any other selectable position to yield the desired implement configuration.

For example, to pass from the first longitudinal position illustrated in FIGS. 1*a*, 2*a* and 3*a* to the second transversal position illustrated in FIGS. 2*b*, 3*b* and 4, after pressing the release buttons, the end effecter 10 is pivoted in any direction about the attachment axis to extract plungers 40*a* and 40*d* from the openings 24*a*, 24*b* and bring plungers 40*b* and 40*c* in register with the openings. To pass from that second position to the coplanar broom like third configuration illustrated in FIGS. 2*c* and 3*c*, the end effecter 10 is rotated about the buttons axis in the clockwise direction, according to that view, so that the plungers 40*b* and 40*d* will be extracted from openings, rotated by 90° and reinserted into the conforming openings.

Figure 6:
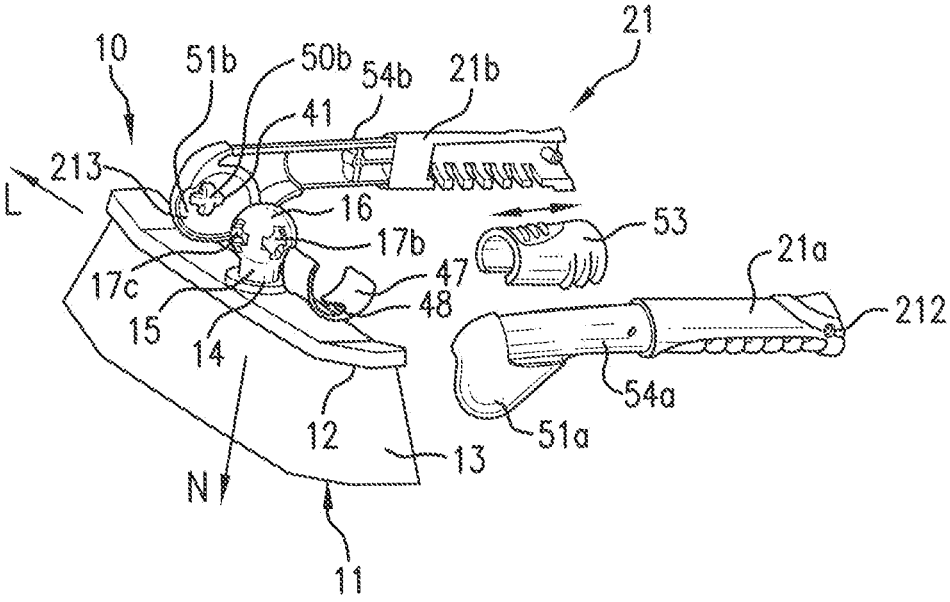
FIG. 6 is a perspective exploded view of the distal portion of the implement, in the second configuration of FIG. 2*b*, showing internal details of a multi-axis lockable articulated joint according to another embodiment.
Figure 7:
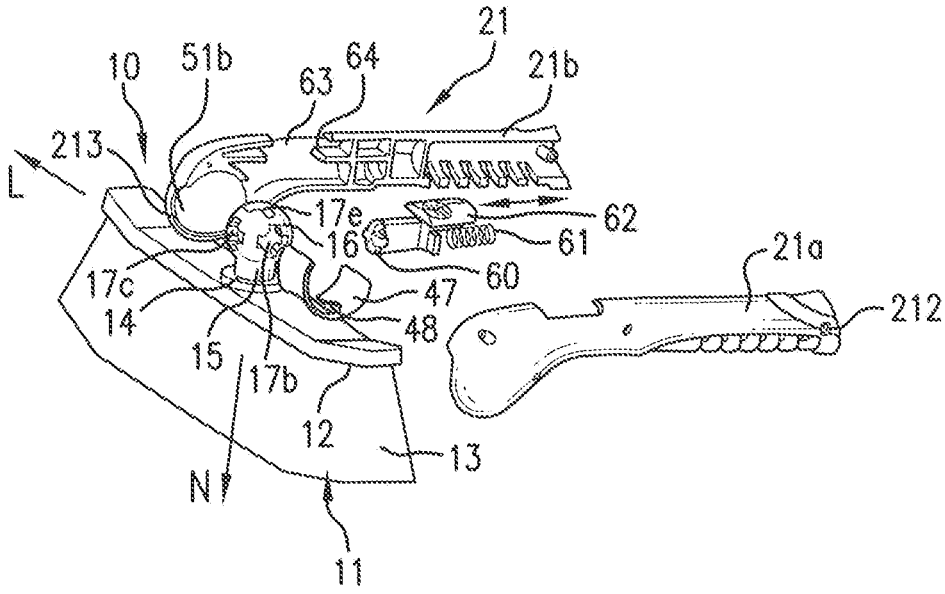
FIG. 7 is a perspective exploded view of the distal portion of the implement, in the second configuration of FIG. 2*b*, showing internal details of a multi-axis lockable articulated joint according to a further embodiment.

Referring now to FIGS. 6 and 7, which are perspective exploded views of the distal portion of the implement, in the second configuration of FIG. 2*b*, showing internal details of a multi-axis lockable articulated joint according to two distinct embodiments, alternative embodiments of the multi-axis lockable articulated joint of the end effecter 10 of the implement 1 will be described. Ridges or plungers projecting from the distal end portion 21 selectively engage the recesses to provide the locking action.

As shown on FIGS. 3*a*-3*c*, and 4, the plungers 40*a*-40*d* are free floating, in the sense that they are not permanently connected in a fixed position to other components of the multi-axis articulated hand implement 1. In those embodiments, pushing the plungers 40*a*-40*d* into corresponding recesses 17*a*-17*d* enables rotation of the distal end portion 21 around the ball 16, unlocking the implement 1. Other embodiments will now be presented, in which plungers are not free-floating, but rather attached to or maintained by elements that are external to the ball 16, these elements doubling as plunger holding portions. In those embodiments, pushing these plungers into the ball has the effect of locking the implement 1. In FIG. 6, an embodiment of the multi-axis joint in provided, wherein the free-floating plungers 40*a*-40*d* and the matching openings 24*a* and 24*b* are replaced by cross shaped ridges 50*a* and 50*b* molded into the internal face of the shells 51*a* and 51*b* of the distal end portions 21*a* and 21*b*. The ridges 50*a* and 50*b* form plungers of a distinct type, when compared to the plungers 40*a*-40*d*, but still provide similar locking and unlocking functions. The internal face of the shells 51*a* and 51*b* act as plunger holding portions. Sleeve 53 sliding on neck portions 54*a* of 21*a* and 54*b* of 21*b* replaces the push buttons 30*a* and 30*b* as the actuating means. Thereby, sliding sleeve 53 away from the end effecter 10 enables rotation thereof by enabling shells 51*a* and 51*b* to move away from each other. Reciprocally, sliding the sleeve toward the end effecter 10 urges the shells closer to each other, forcing the ridges 50*a* and 50*b* into the recesses 17 of the ball 16 to lock the end effecter in a selected position. Moreover, a lock means (not shown) for maintaining the sleeve 53 in the locking position may be provided. As expressed hereinabove, rectangular shaped ridges 50*a* and 50*b* and matching cross shaped openings recesses 17*a*-*d* may be used in a variation to the embodiment of FIG. 6, allowing locking the multi-axis joint in the same configurations.

As in the case of the embodiment of FIG. 6, a non-free-floating plunger is used in the embodiment of FIG. 7. In this embodiment, a single manually activated plunger 60 forwardly biased against ball 16 by spring 61, which abuts against a seat 64 within the distal end portion 21, is slidably mounted into a compartment (plunger holding portion) of distal end portion 21 for reciprocating displacement therein. The plunger 60 comprises a thumb friction actuation tab 62 emerging from the distal portion 21 through slot 63, the friction actuation tab enabling manual displacement of the plunger 60 in or out of engagement with any one of the recesses 17*a*-*d* of the ball 16. According to the position of the plunger, a fifth recess 17*e* is provided at the apex, of the ball 16 to enable locking of the end effecter 10 in the broom-like coplanar position, the working face normal axis N being substantially parallel to the longitudinal axis of the handle 20. In a variation, the plunger 60 may have a rectangular shape, capable of being inserted into each of the recesses 17*a*-*e* in two perpendicular positions.

Figure 8:
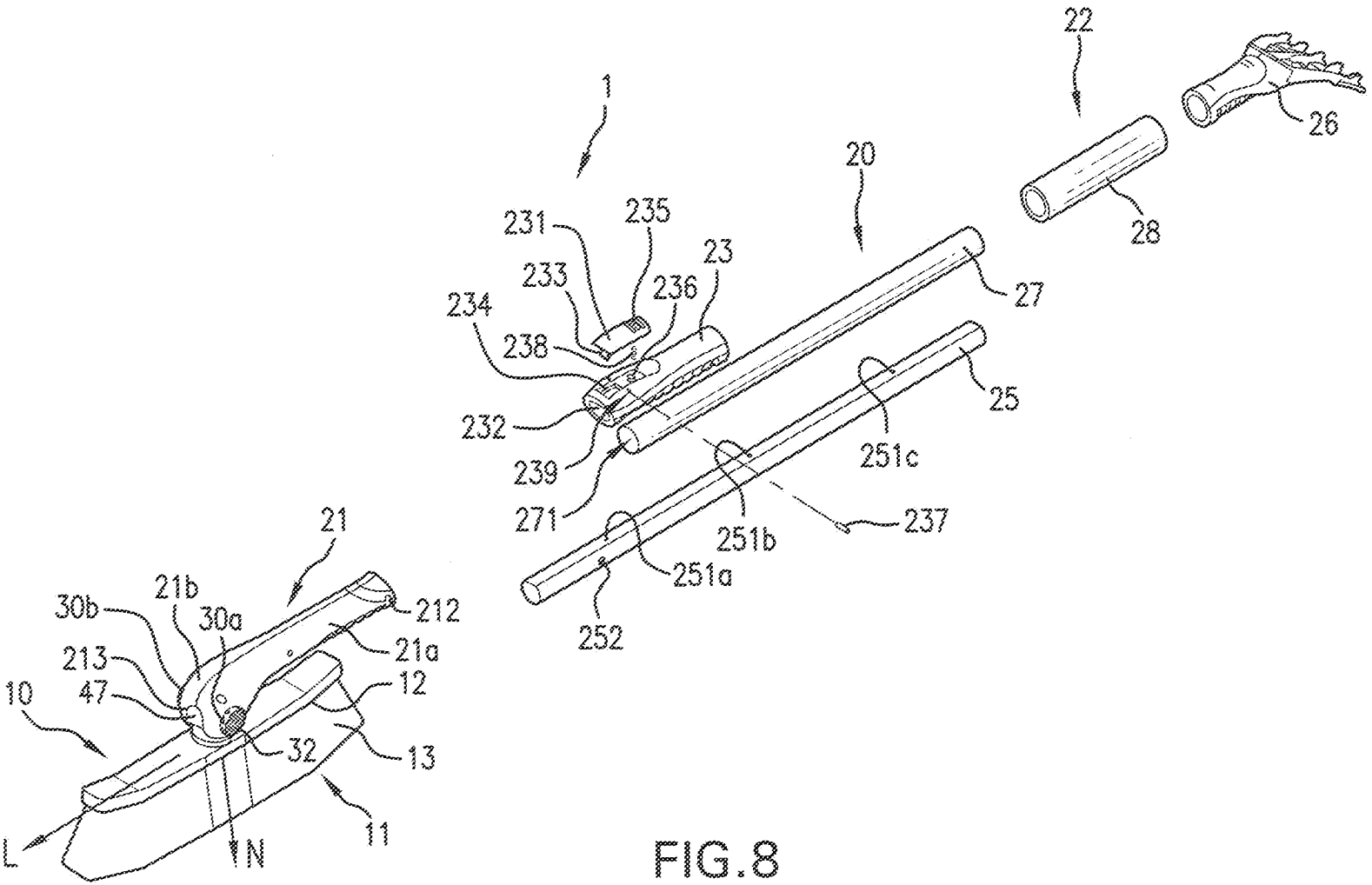
FIG. 8 is a perspective exploded view of another example of extensible snow brush according to an embodiment of the present disclosure, showing details of the extensible handle.

Referring now to FIG. 8, which is a perspective exploded view of another example of extensible snow brush according to an embodiment of the present disclosure, showing details of the extensible handle, the implement 1 is illustrated with an exploded adjustable length handle 20 to show the details thereof. A first rigid tubular member 25, provided with axially spaced through holes 251*a*-*c*, is assembled to the distal end portion 21 by attaching a fastener such as a rivet through aligned holes such as 212 and 252. At the proximal end 22 of the handle, a scraper 26 is similarly assembled to the proximal end of a rigid tubular sleeve member 27, which is then covered by a soft handle gripping sleeve 28. A tubular length adjusting coupling device 23 is assembled at the distal end of the sleeve 27. The inner bore 271 of the tubular member 27 as well as the internal bore 232 of the coupling device 23 are adapted to enable smooth sliding of the tubular member 25 therein to provide a locking adjustable length extensible tubular handle.

Locking of the handle 20 at different length positions is enabled by insertion of a locking stud 233 projecting from below an operating member 231 and reaching the outer surface and the mating holes 251*a*-*c* of the rigid tubular member 25 through the opening 234. The operating member 231 is rocking about a pivot (not shown) and comprises a friction portion 235 outwardly biased by a resilient member, such as compression coil spring 238 held on the seat 236, to urge the stud 233 into any of the holes 251*a*-*c*. The friction portion 235 may be pushed downwardly to compress the spring 238 and extract the stud from the current hole 251. The relative axial position of the members 25 and 27 may then be changed by sliding the coupling device 23 over the member 25. Release of the friction portion 235 of the operating member 231 then enables engagement of the stud into a different hole 251 to configure the handle 20 to a different length.

Figure 9:
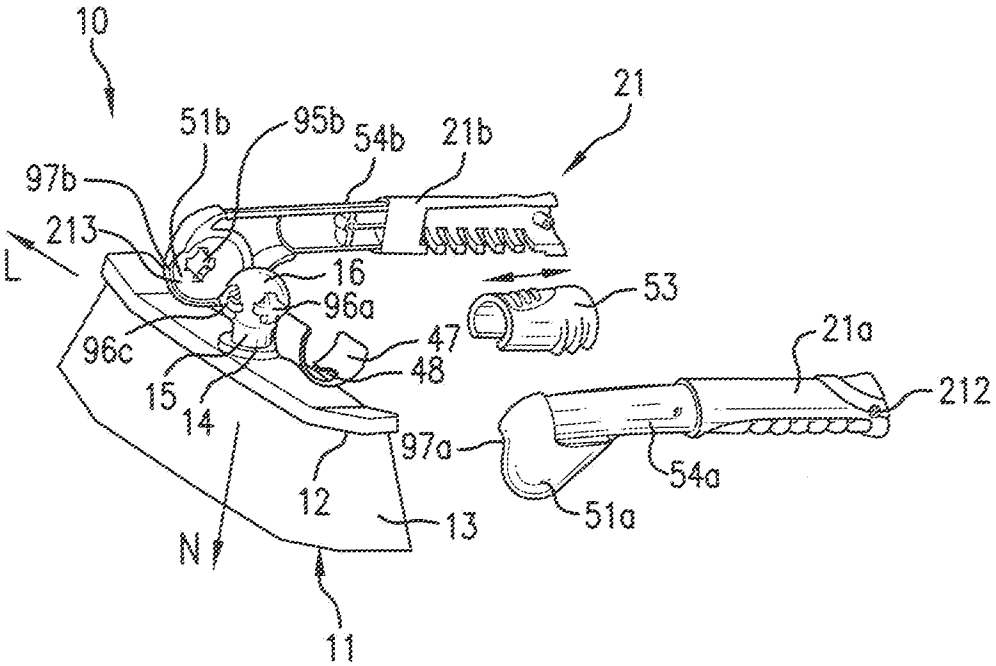
FIG. 9 is a perspective exploded view of the distal portion of the implement, in the second configuration of FIG. 2*b*, showing internal details of the multi-axis lockable articulated joint according to a variation.

FIG. 9 is a perspective exploded view of the distal portion of the implement, in the second configuration of FIG. 2*b*, showing internal details of the multi-axis lockable articulated joint according to a variation. This embodiment is most easily described by highlighting its distinctions from the embodiment of FIG. 6. Ridges 50*a* and 50*b*, molded into the internal face of the shells 51*a* and 51*b* of the distal end portion 20 of FIG. 6, are replaced in FIG. 9 by recesses 95*a*-*b* cut into the shells 51*a* and 51*b*. The recess 95*a* cut into the shell 51*a* is not shown due to the perspective of FIG. 9. The recesses 95*a*-*b* are conforming to ridges 96*a*-*d* built on the periphery of the ball 16 so that the ridges 96*a*-*d* are capable of nesting into the recesses 95*a*-*b*. The ridges 96*a*-*d* have a non-circular, rotationally symmetric shape. Other elements of the multi-axis joint of FIG. 6 may remain unchanged, as shown on FIG. 9. Operation of the sleeve 53 enables the shells 51*a* and 51*b* to move away from each other or to be brought again close to each other, unlocking and then locking the joint. A front opening formed to two halves 97*a* and 97*b* on the distal end 21 allows moving the shells 51*a* and 51*b* together while providing clearance for one of the ridges 96*a*-*d*, for example ridge 96*c* in the configuration of FIG. 9. Embodiments of a lockable articulated joint may comprise a single ridge 96 on the ball 16 and a single conforming recess 95, the rotational symmetry of the ridge 96 allowing locking of the joint in at least two selectable positions. Other embodiments may comprise a plurality of ridges 96 and a single conforming recess 95, or a single ridge 96 with a plurality of conforming recesses 95. Yet other embodiments may comprise a plurality of ridges 96 and a plurality of conforming recesses 95, as shown on FIG. 9. The ridges 96 may have beveled rounded edges, allowing unlocking the articulated joint by application of a moderate torque. It may readily be appreciated that the embodiments of FIGS. 6 and 9 operate similarly and that a simple matter of design choice may lead those of ordinary skill in the art to select one over the other. Of course, at least some of the previously shown embodiments of the lockable articulated joint may be modified, as in FIG. 9, by replacing the recesses, plungers and plunger holding portions of the previous Figures with ridges 96*a-d* and conforming recesses 95*a-b* as shown on FIG. 9.

One may thus easily appreciate that the above described embodiments of the multi-axis articulated implement according to the present disclosure obviate the limitations and drawbacks of earlier devices, namely by providing selectable orientation of the end effecter working surface normal plane (formed by the end effecter longitudinal axis and the working surface normal axis) in a plurality of positively lockable positions according to three orthogonal configuration modes to provide maximal working versatility. For example, the implement may be embodied into a multi-axis articulated extensible snow brush that may be used for conveniently and ergonomically removing snow or debris from differently oriented surfaces. Furthermore, the implement 1 may be easily operated by a user, especially when mittens are being worn, hindering manual dexterity.

Although the present disclosure has been described hereinabove by way of non-restrictive, illustrative embodiments thereof, these embodiments can be modified at will within the scope of the appended claims without departing from the spirit and nature of the present disclosure.

What is claimed is:

1. A lockable articulated joint comprising:

a first member having a ball shaped attachment, a recess being provided about a periphery of the ball shaped attachment;

a conforming plunger adapted for movable nesting into the recess, the conforming plunger having a non-circular and rotationally symmetric cross-section; and a second member adapted for pivotally receiving the ball shaped attachment and comprising a plunger holding portion;

thereby defining:

a locked position, which is provided when the conforming plunger is partly engaged in the recess and aligned with the plunger holding portion, wherein the ball shaped attachment is locked in one of at least two selectable locked positions;

an unlocked position, which is provided when the conforming plunger is substantially completely engaged in the recess, wherein the ball shaped attachment is allowed to rotate around two orthogonal axes within the second member;

a user depressible button for engaging the conforming plunger substantially completely in the recess and transiting from the locked position to the unlocked position; and a spring located in the recess for urging the conforming plunger toward the plunger holding portion when the conforming plunger and the plunger holding portion are aligned, thereby maintaining the locked position; and wherein the user depressible button for engaging the conforming plunger substantially completely in the recess is for compressing the spring.

2. The lockable articulated joint of claim 1, wherein:

the recess comprises a plurality of recesses provided about the periphery of the ball; and the conforming plunger comprises a plurality of conforming plungers for movable nesting into the plurality of recesses;

wherein the locked position comprises a locked position wherein the ball shaped attachment is locked in one of a plurality of selectable locked positions.

3. The lockable articulated joint of claim 2, wherein:

the plurality of recesses comprises a first recess, a second recess and a third recess, the third recess being outside of a plane formed by the first recess, the second recess and a center of the ball.

4. The lockable articulated joint of claim 3, wherein:

the first recess and the center of the ball define a first segment, the second recess and the center of the ball define a second segment, the first and the second segments forming a right angle at the center of the ball.

5. The lockable articulated joint of claim 4, wherein:

the third recess and the plane define a third segment being at a right angle from the plane formed by the first recess, the second recess and the center of the ball.

6. The lockable articulated joint of claim 1, wherein:

the plunger holding portion comprises a plurality of plunger holding portions;

wherein the locked position is provided when the conforming plunger is nested in part in the recess and aligned with one of the plurality of plunger holding portions.

7. The lockable articulated joint of claim 1, wherein:

the recess comprises a plurality of recesses provided about the periphery of the ball;

the conforming plunger comprises a plurality of conforming plungers, each one of the plurality of conforming plungers for movable nesting into a corresponding one of the plurality of recesses; and the plunger holding portion comprises a plurality of plunger holding portions;

wherein the locked position is provided when at least one of the plurality of conforming plungers is engaged in part in the corresponding one of the plurality of recesses and aligned with one of the plurality of plunger holding portions, wherein the unlocked position is provided when each one of the plurality of conforming plungers is substantially completely engaged in the corresponding one of the plurality of recesses.

8. The lockable articulated joint of claim 7, wherein:

the conforming plunger has beveled rounded edges;

whereby applying a torque between the first member and the second member, when each one of the plurality of conforming plungers is being substantially completely engaged in the corresponding one of the plurality of recesses, is for transiting from the locked position to the unlocked position.

9. The lockable articulated joint of claim 1, wherein:

the shape of the conforming plunger is one of: a star having at least three identical branches, a square, a cross, and a polygon.

10. A multi-axis articulated implement comprising:

an elongated end effecter having a ball shaped attachment defining a periphery, the ball shaped attachment having a plurality of recesses provided about the periphery;

a conforming plunger adapted for movable nesting into at least one of the plurality of recesses, the conforming plunger having a non-circular and rotationally symmetric cross-section; and an elongated handle portion defining a proximal end and a distal end portion adapted to pivotally receive the ball shaped attachment and comprising at least one plunger holding portion;

thereby defining:

a plurality of locked positions, which are provided when the conforming plunger is partly engaged in the recess and aligned with one of the at least one plunger holding portions; and an unlocked position, which is provided when the conforming plunger is either substantially completely engaged in the plurality of recesses or substantially completely pulled out of the plurality of recesses, wherein the ball shaped attachment is allowed to rotate around two orthogonal axes;

a user-displaceable button for either substantially completely engaging the conforming plunger in or substantially completely pulling the conforming plunger out of the plurality of recesses of the plurality of recesses; and a spring inserted into one of the plurality of recesses for biasing the conforming plunger toward an exit of the recess and for maintaining the conforming plunger in contact with the at least one plunger holding portion.

11. The multi-axis articulated implement of claim 10, further comprising:

an actuation tab mounted on the distal end portion for maintaining the conforming plunger completely engaged in one of the plurality of recesses when the actuation tab is unbiased, thereby maintaining the multi-axis articulated implement in one of the plurality of locked positions, and wherein the actuation tab can pull the conforming plunger out of the one of the plurality of recesses when the actuation tab is biased, thereby transiting from the one of the plurality of locked positions to the unlocked position.

12. The multi-axis articulated implement of claim 10, wherein the recess comprises a first recess provided about the ball shaped attachment and a second recess provided about the ball shaped attachment at a location diametrically opposed to the first recess, wherein the conforming plunger comprises a first conforming plunger and a second conforming plunger, each one of the two conforming plungers for movable nesting in one of the first recess and the second recess, the multi-axis articulated implement further comprising:

two buttons, each one of the buttons being provided on a diametrically opposed side of the distal end portion, for engaging the first and second conforming plungers completely in two corresponding recesses, thereby transiting from one of the plurality of locked positions to the unlocked position.

13. The multi-axis articulated implement of claim 10, wherein:

the conforming plunger is molded into an internal face of the distal end portion, the implement further comprising a sleeve capable of sliding on the distal end portion for pushing the conforming plunger into one of the plurality of recesses, thereby transiting from the unlocked position to one of the plurality of locked positions.

14. The multi-axis articulated implement of claim 10, comprising:

a brush on a working face of the end effecter; and a scraper on the proximal end of the handle portion.

15. A lockable articulated joint comprising:

a first member having a ball shaped attachment, a ridge being provided about a periphery of the ball, the ridge having a non-circular and rotationally symmetric cross-section; and a second member adapted to pivotally receive the ball shaped attachment and comprising a plurality of conforming recesses adapted for nesting of the ridge;

thereby defining:

a locked position, which is provided when the ridge is engaged at least in part in one of the plurality of conforming recesses, wherein the ball shaped attachment is locked in one of at least two selectable locked positions;

an unlocked position, which is provided when the ridge is substantially completely pulled out of the plurality of conforming recesses, wherein the ball shaped attachment is allowed to rotate around two orthogonal axes within the second member; and a user-displaceable button for pulling the ridge out of the plurality of conforming recesses and transiting from the locked position to the unlocked position; and a spring located in the recess for urging the conforming plunger toward the plunger holding portion when the conforming plunger and the plunger holding portion are aligned, thereby maintaining the locked position; and wherein the user depressible button for engaging the conforming plunger substantially completely in the recess is for compressing the spring.

16. The lockable articulated joint of claim 15, wherein:

the ridge comprises a plurality of ridges;

wherein the locked position is provided when one of the plurality of ridges is engaged at least in part in the one of the plurality of conforming recesses and the unlocked position is provided when the plurality of ridges are substantially completely pulled out of the plurality of conforming recesses.

17. The lockable articulated joint of claim 15, wherein:

the ridge comprises beveled rounded edges;

whereby applying a torque between the first member and the second member is for transiting from the locked position to the unlocked position.

18. The lockable articulated joint of claim 10, wherein the elongated end effecter comprises a working face defining a longitudinal axis and a normal axis, and wherein the plurality of locked positions comprises:

a first locked position wherein the longitudinal axis of the working face extends substantially parallel to the handle;

a second locked position wherein the longitudinal axis of the working face extends substantially perpendicular to the handle and the normal axis of the working face extends substantially perpendicular to the handle; and a third locked position wherein the longitudinal axis of the working face extends substantially perpendicular to the handle and the normal axis of the working face extends substantially parallel to the handle.

* * * * *